US007134553B2

(12) United States Patent
Stephens

(10) Patent No.: US 7,134,553 B2
(45) **Date of Patent: *Nov. 14, 2006**

(54) PACKAGING FOR FRAGILE ITEMS

(75) Inventor: Thomas Stephens, Los Gatos, CA (US)

(73) Assignee: RSVP Operations LLC, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/900,708

(22) Filed: Jul. 28, 2004

(65) Prior Publication Data

US 2005/0023163 A1 Feb. 3, 2005

Related U.S. Application Data

(63) Continuation of application No. 10/210,408, filed on Jul. 31, 2002, now Pat. No. 6,840,381.

(51) Int. Cl.
*B65D 81/02* (2006.01)

(52) U.S. Cl. ..... 206/589; 206/592

(58) Field of Classification Search ..... 206/521, 206/587, 588, 589, 591, 592, 593, 594, 425, 206/449, 454

See application file for complete search history.

(56) References Cited

U.S. PATENT DOCUMENTS 1,958,050 A * 5/1934 Koppelman ..... 162/116
2,769,534 A 11/1956 Lindgard
4,515,272 A 5/1985 Newhouse
5,131,543 A 7/1992 Stephens
5,226,543 A 7/1993 Foos et al.
5,249,685 A 10/1993 Stephens
5,385,232 A 1/1995 Foos et al.
5,445,292 A 8/1995 Slomski et al.
5,515,976 A 5/1996 Moren et al.
5,545,370 A 8/1996 Moren et al.
5,586,677 A 12/1996 Foos
5,634,559 A 6/1997 Foos et al.
5,788,105 A 8/1998 Foos
5,799,796 A 9/1998 Azelton
5,806,683 A * 9/1998 Gale ..... 206/587
6,010,007 A 1/2000 Moren et al.
6,082,546 A 7/2000 Liao
6,123,200 A 9/2000 Stephens et al.
6,142,304 A 11/2000 Moren et al.
RE37,253 E 7/2001 Moren et al.
6,405,866 B1 * 6/2002 Arima ..... 206/453
6,520,337 B1 2/2003 Smith
6,705,469 B1 * 3/2004 Slot ..... 206/587
6,840,381 B1 * 1/2005 Stephens ..... 206/589

* cited by examiner

*Primary Examiner*—Shian T. Luong
(74) *Attorney, Agent, or Firm*—Fliesler Meyer LLP

(57) ABSTRACT

One or more unique hinges are provided within panels of a fragility packaging article for use in retaining one or more fragile articles within a container (e.g., a corrugated box). The unique hinges provide predicted deformation paths that assist in protecting one or more fragile items stored in the container. One of the unique hinges is a diamond shaped hinge that provides at least two predicted deformation paths. Other unique hinges of the present invention includes a gusset hinge, a step hinge, and a v-hinge, each of which provides at least one predicted deformation path. The predicted deformation paths reduce permanent deformation and provide for improved overall cushioning, thereby increasing protection of fragile items and significantly reducing damage that may occur to the fragile items. The unique hinges of the present invention also improve the cosmetic appearance of a fragility packing article because a majority of crushing occurs along the unique hinges, preventing random unsightly crush points from occurring throughout the packaging article.

22 Claims, 11 Drawing Sheets

PACKAGING FOR FRAGILE ITEMS

CLAIM OF PRIORITY

This application is a continuation of, and claims priority to, U.S. patent application Ser. No. 10/210,408, entitled "Packaging for Fragile Item," filed on Jul. 31, 2002, now U.S. Pat. No. 6,840,381.

FIELD OF THE INVENTION

The present invention relates to packaging for fragile items such as computer components, electronic devices and the like.

BACKGROUND OF THE INVENTION

Fragility packaging as used in the present context refers to a type of packaging employing plastic structures (e.g., thermoformed plastic structures) which provide both structural support and shock absorption to the fragile items they are designed to carry. Such packages are typically used in combination with conventional corrugated cartons, and define shock absorbing air spaces between the packaged item and the inner surfaces of corresponding panels of the carton. Such packages can also be plastic totes that are used as material handling devices. Among the many advantages of thermoformed fragility packages are that they are recyclable, provide cushioning against repeated shock loading, are compact to ship and store in bulk. Examples of fragility packages are described in commonly assigned U.S. Pat. Nos. 5,226,543; 5,385,232; 5,515,976; 6,010,007; and 6,142,304, all of which are incorporated herein by reference.

One embodiment of the above-described fragility packaging is used for shipping computer components such as disk drives in bulk from manufacturing to assembly points. The distance such packages are designed to travel may vary from one end of a factory to another, to one end of the world to another. Conventional bulk disk drive fragility packages provide a main platform divided into cells for locating and separating each drive relative to the adjacent drive. Generally parallel side edges of the main platform are provided with integrally formed hinged flaps. Preferably, these flaps are also divided into cells which are in registry with the main platform cells, and once placed in a carton, the flaps provide protection to the sides of the drives in each cell. Examples of such packages are manufactured and sold by R.S.V.P., Inc., Soquel, Calif. under the trademark U-PAD.

Often, U-PAD packages will be provided with a lid, which is typically a thermoformed, generally planar panel also provided with cells in registry with the other cells. When the lid is placed over the packaged disks in the U-PAD already in the carton, the tops of the disk drives will also be separated from adjacent disk drives, and the lid will also separate the disk drives from the corresponding top panel or panels of the carton.

U-PAD packages may vary in configuration depending on the size and type of items (e.g., disk drives) being packaged. In some cases, a single row of items will be packaged in separated fashion with a carton, while in others, two rows of items are placed in parallel relationship to each other. In the latter situation, the main platform is provided with an integrally formed, centrally located, vertically projecting sidewall structure. This sidewall structure is also divided into cells to engage the inner sides of each disk drive in each of the two rows of packaged items. In the case of dual row packages, the corresponding lid is also provided with separated, parallel rows of cells to be in registry with the cells of the so-called DOUBLE U-PAD package.

With the increasing popularity of U-PAD packaging, and the corresponding trend in the computer industry to out source components, a wider variety of components and other packaged items are being shipped in this type of package. Also, each manufacturer has its own specifications for the properties which the packaging must have to provide satisfactory protection. Thus, depending on the packaged item and the manufacturer, various regions and/or portions of the fragility package need to have a range of flexibility, rigidity and/or shock absorptive properties. For example, packages designed to be carried by hand from one end of a factory to another, or to be shipped by themselves, must be designed to withstand a greater drop height than packages designed to be loaded onto a shipping pallet for transport on a truck.

Another packaging design requirement of component manufacturers is that the packaging be easily installed in the carton or tote and loaded with fragile items by relatively unskilled workers, or even by machine, in as rapid a fashion as possible while still taking into account the inherent fragility of the items.

The packaging manufacturer is then forced to develop many designs of fragility packaging to satisfy customers shipping relatively similar fragile items. As such, to make the most efficient use of resources, the goal of the packaging manufacturer is to provide packaging with a maximum range of properties using as few distinctive package designs as possible.

One of the ways a thermoformed packaging structure protects fragile items is by flexing and thereby absorbing forces that are applied to a carton within which the thermoformed structure (and fragile items) are placed. Such forces may result, for example, from the carton being dropped or knocked over, or from further cartons being placed on top of the carton or pushed against the carton. A problem with conventional thermoformed packaging structures is that they often crush or deform at unpredictable points (e.g., when applied forces overcomes the flexibility of the structure). A result of unpredictable crush points is that the fragile items may be damaged. A further result of such unpredictable crush points is that the integrity of the packaging structure may be ruined, and thus fragile items may be damaged by the force causing the unpredicted crush point and/or later applied forces. Additionally, such unpredicted crush points are unsightly and may cause a customer unpacking the fragile items to question whether the producer and/or shipper took proper care of the fragile items. This may strain otherwise good relations between parties. Accordingly, there is a desire to overcome the problems caused by such unpredictable crushing or deformation of packaging structures.

BRIEF SUMMARY OF THE INVENTION

The present invention is directed to improved fragility packaging articles for use in retaining and protecting at least one fragile item within a container. Each fragility packaging article is made up of one or more panels. For example, a fragility packaging article may include a bottom panel and a pair of side panels that together form a U-shaped packaging article (often referred to as a U-PADTM) that can be placed within the container. Each panel is similar in that each includes a base for resting on or against an inner surface (e.g., a bottom or a side) of the container. Each panel also includes a platform, located a distance or cushioning space from the base, for supporting at least a portion of a fragile item. A front wall rises from a front edge of the base to a front edge of the platform. Similarly, a rear wall rises from a rear edge of the base to a rear edge of the platform. Additionally, a first side wall rises from a first side edge of the base to a first side edge of the platform. A second side wall similarly rises from a second side edge of the base to a second side edge of the platform. The front wall, rear wall, first side wall and second side wall define a skirt that suspends the platform above the base so that a shock absorbing air cushioning space is defined between an inner surface of the container and the platform. Typically, a plurality of ribs project from the platform to define at least one item-supporting cell that is configured to receive one fragile item.

Embodiments of the present invention are directed to unique hinges that are incorporated into the above described panels (or other similar panels) to provide for, among other things, improved cushioning of fragile items. The unique hinges of the present invention provide for predicted deformation paths thereby reducing and hopefully preventing random crush zones or points from occurring within a panel. Such predicted deformation paths provide many advantages. For example, a packaging articles that incorporate some or all of the unique hinges may be used to ship fragile items having a broad weight range. The predicted deformation paths reduces permanent deformation of the packaging article and provides for improved overall cushioning, thereby increasing protection of fragile items and significantly reducing damage that may occur to the fragile items. The unique hinges of the present invention also improve the cosmetic appearance of a fragility packing article because a majority of crushing occurs along the unique hinges, preventing random unsightly crush points from occurring throughout the article.

One of the unique hinges of the present invention, referred to as a diamond hinge, is typically formed in a corner area of a panel, where the platform, one of the front and rear walls and one of the side walls all meet. The diamond hinge is defined by four substantially planer and substantially triangular surfaces that meet at a point located below the platform. A unique feature of the diamond hinge is that it provides at least two predicted paths for deformation.

Another unique hinge of the present invention, referred to as a v-hinge, typically extends into the front wall (and/or rear wall) and into the platform of a panel. In accordance with an embodiment of the present invention, the v-hinge includes a first v-shaped end in the front wall with a tip pointing generally toward the front edge of the base of the panel. A second v-shaped end in the platform has a tip pointing generally away from the front edge of the base. Generally parallel edges extend between the first v-shaped end and the second v-shaped end, with first and second walls extending down from the edges and meeting at a trough to thereby form a v-shaped channel. The v-hinge provides a predicted path for deformation and also provides for vertical and horizontal movement. More specifically, during deformation the first and second walls of the v-hinge bend toward one another along the trough.

As mentioned above, typically, a plurality of ribs project from the platform to define at least one item-supporting cell that is configured to receive one fragile item. One or more of these ribs may include a gusset portion projecting from one of the front and rear walls to provide additional strength to the rib and to the one of the front and rear walls. A further unique hinge of the present invention, referred to as a gusset hinge, is located in the gusset to provide a path of deformation for the gusset. The gusset hinge comprises a notch in an outer peripheral wall of the gusset. The notch includes a ledge and a face meeting at a corner (which is typically a curved or rounded corner, but may be a sharper corner). During deformation, the ledge and the face bend toward one another along the corner.

Still another unique hinge of the present invention is a step hinge. The step hinge is similar to a gusset hinge in that it includes a ledge and a face that meet at a corner. During deformation, the ledge and the face bend toward one another along the corner. The difference between the step hinge and the gusset hinge is that the step hinge is included within one of the walls (e.g., the front wall) of the panel, rather than in a gusset projecting from the wall.

Further features and advantages of the present invention may be more readily understood by reference to the following description taken in conjunction with the accompanying drawings and claims.

BRIEF DESCRIPTION OF THE DRAWINGS/FIGURES

FIG. 1A a top view of three panel packaging article, according to an embodiment of the present invention;

Figure 2A:
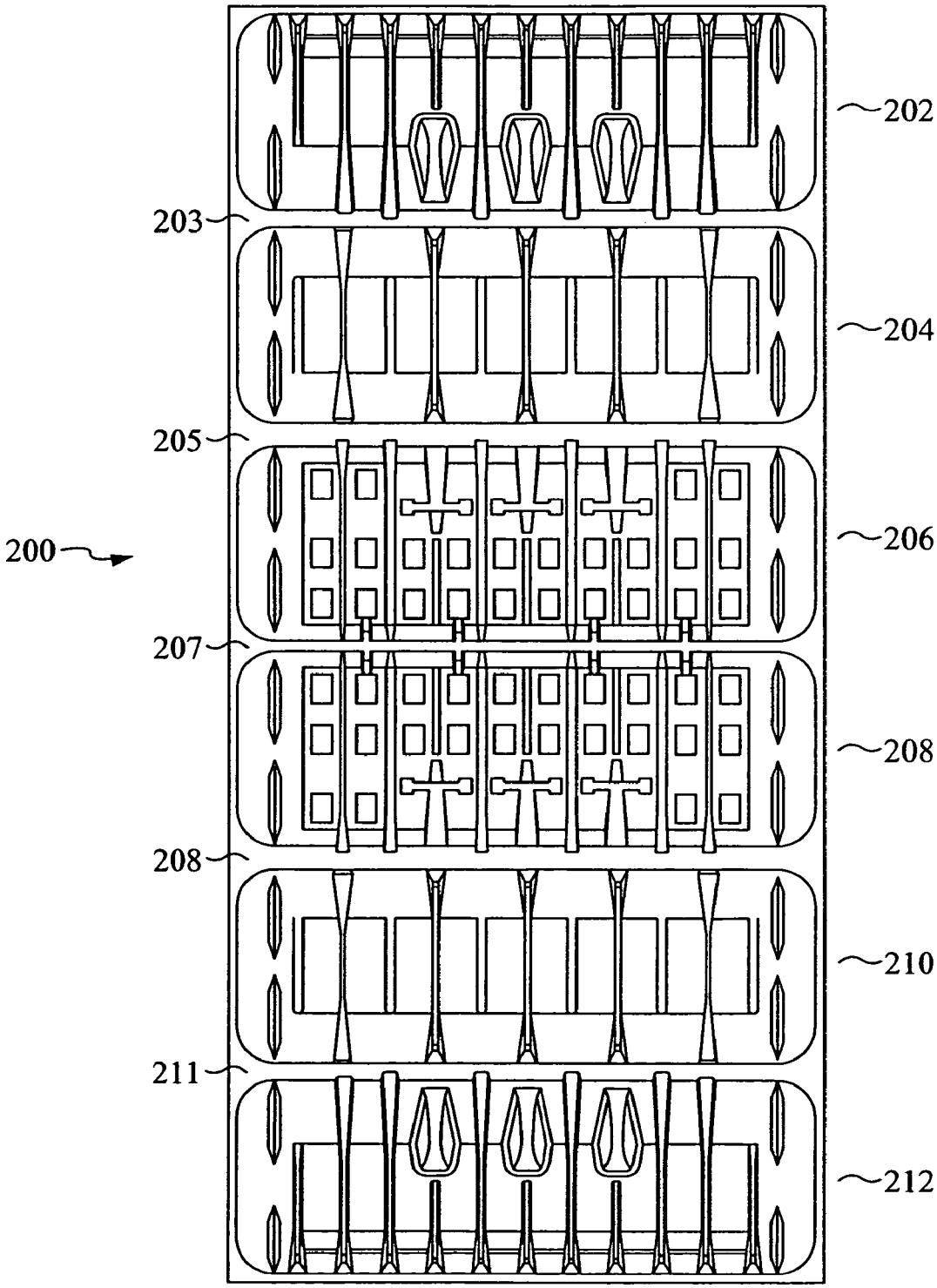
Figure 2B:
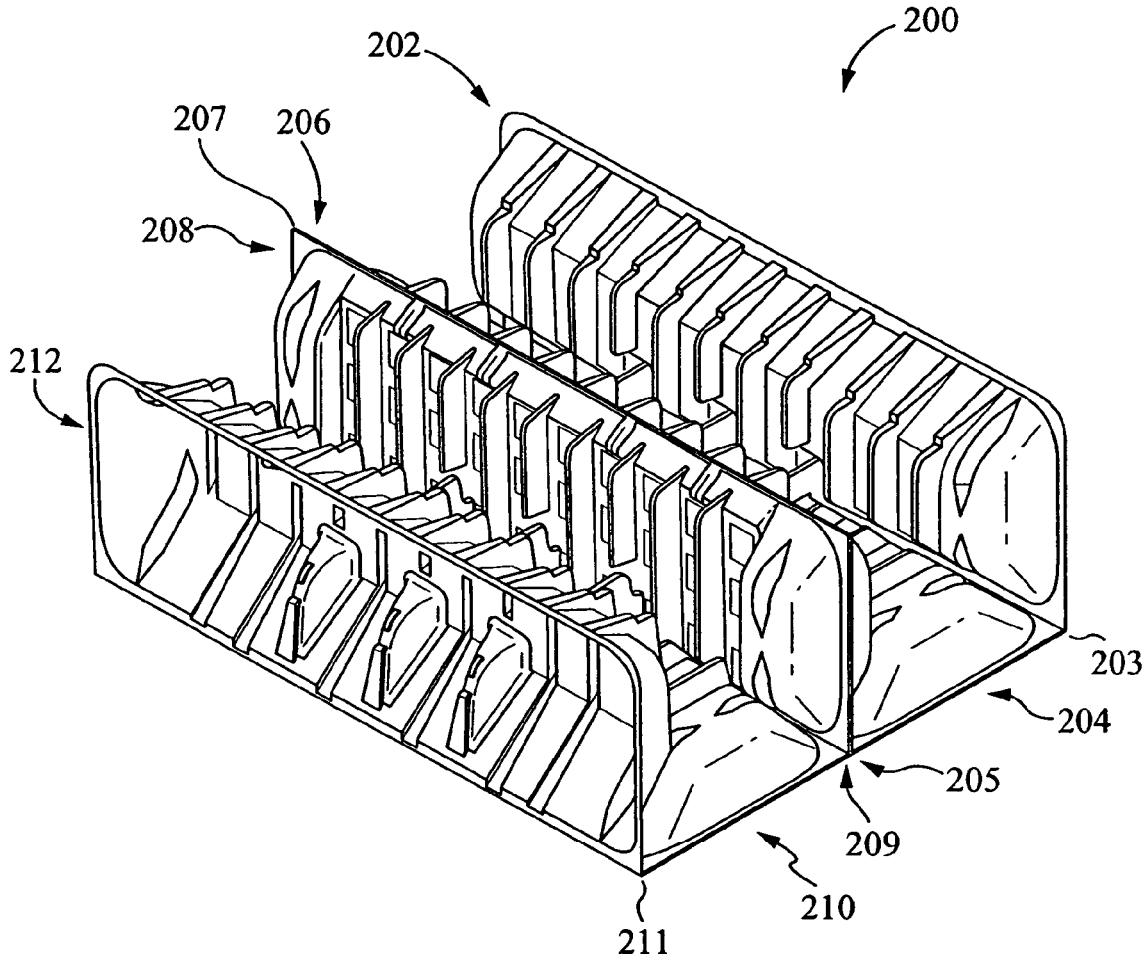
Figure 2C:
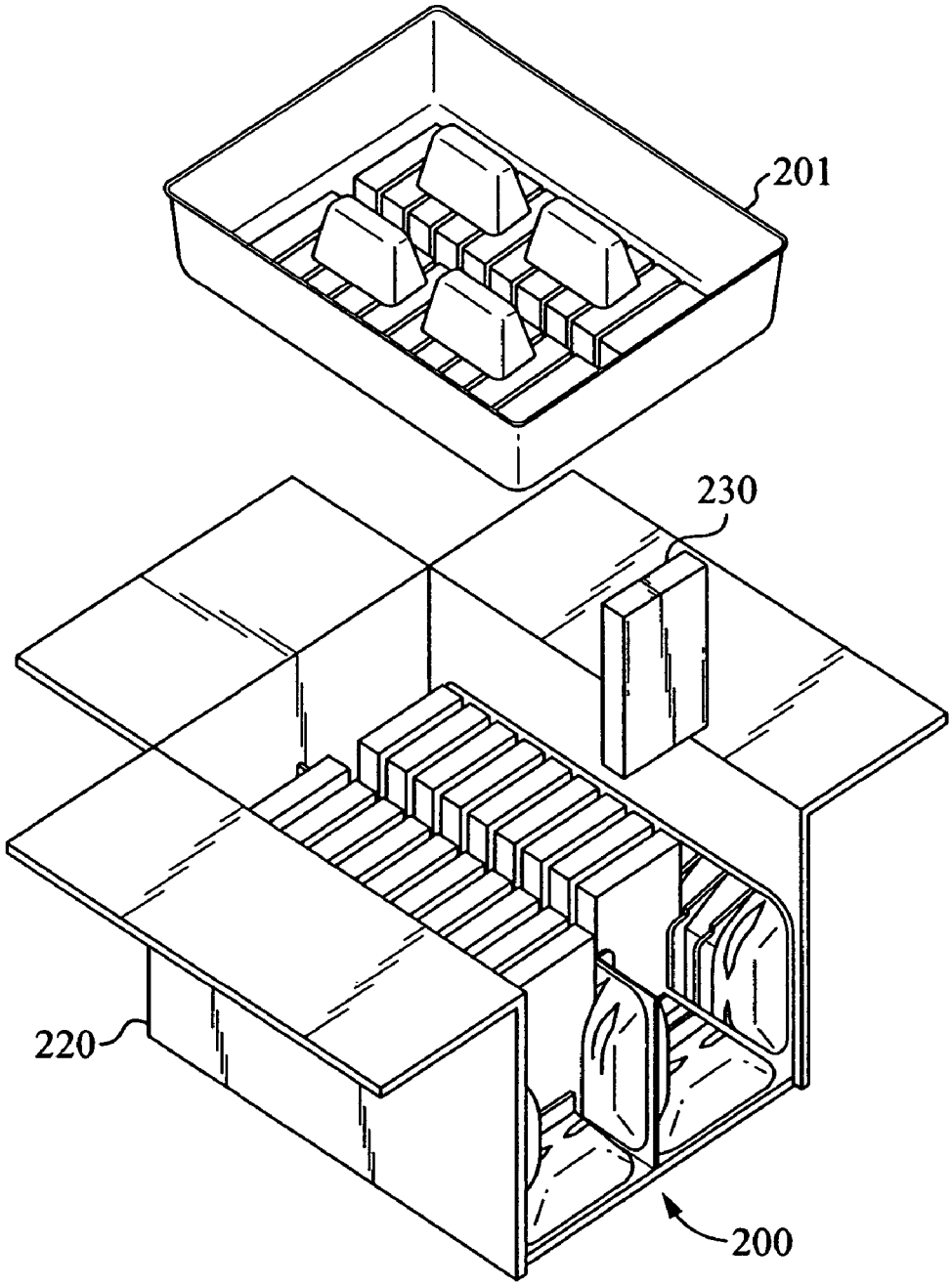
Figure 3A:
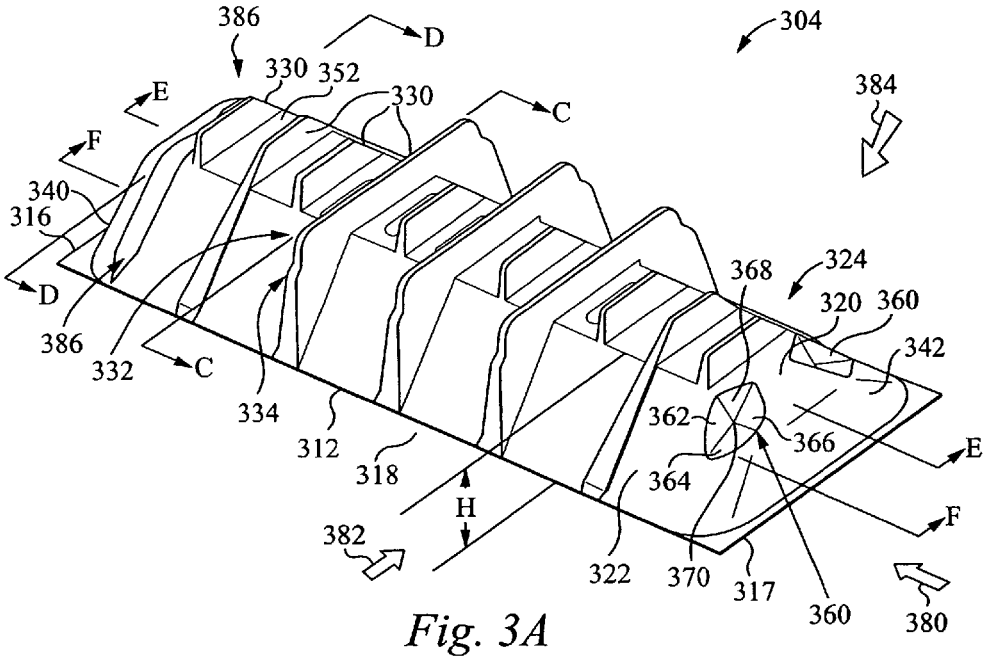
Figure 3B:
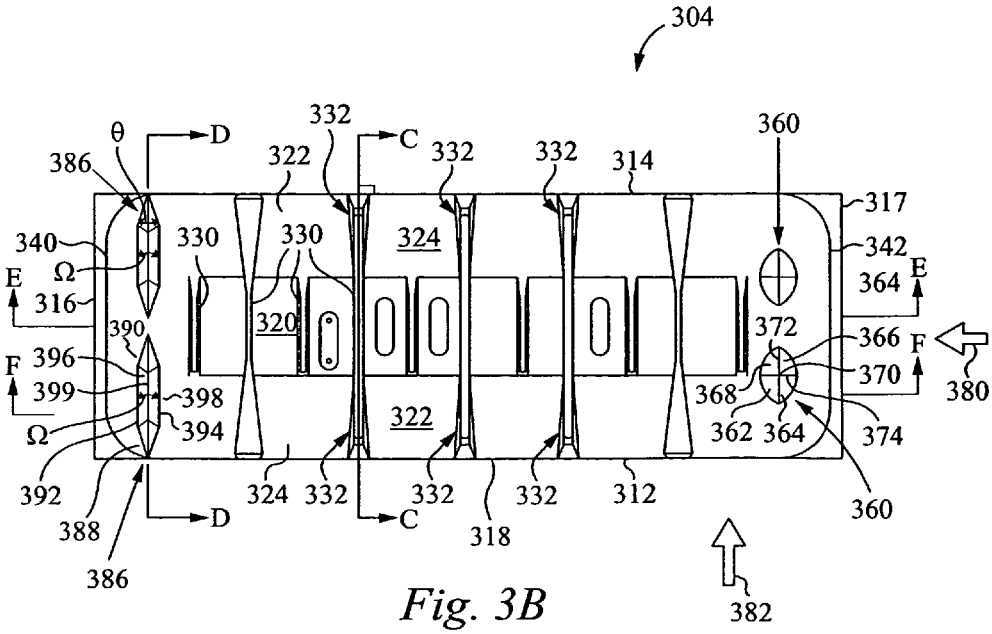
Figure 3C:
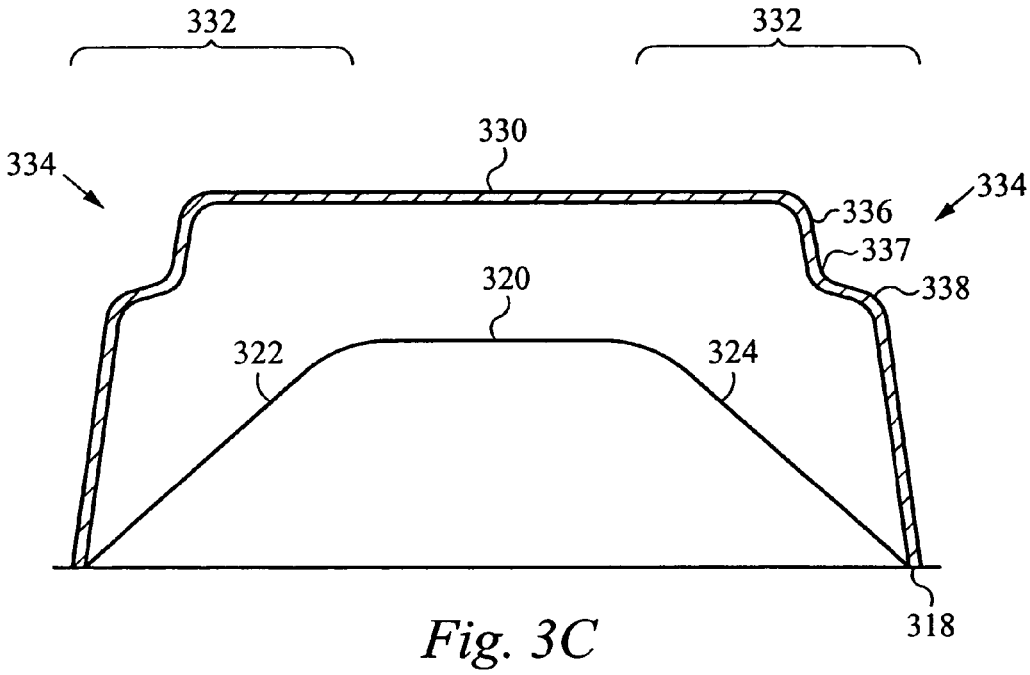
Figure 3D:
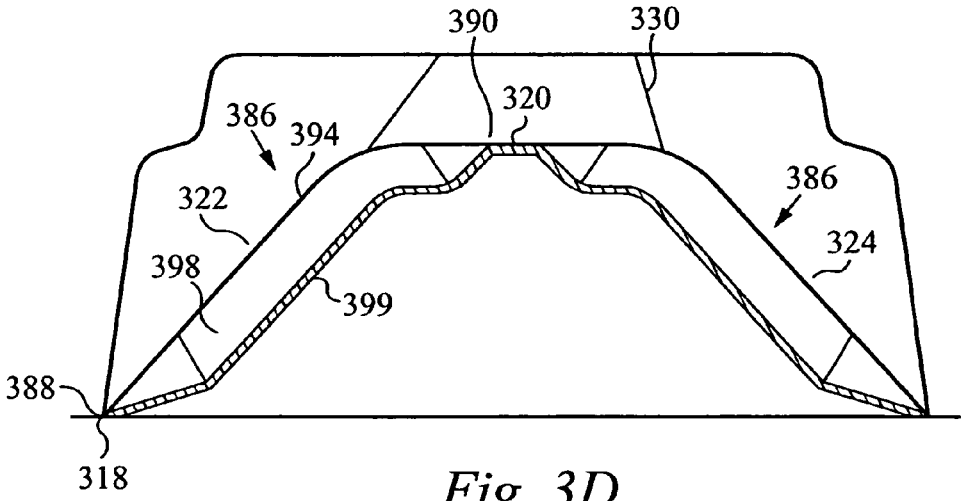
Figure 3E:
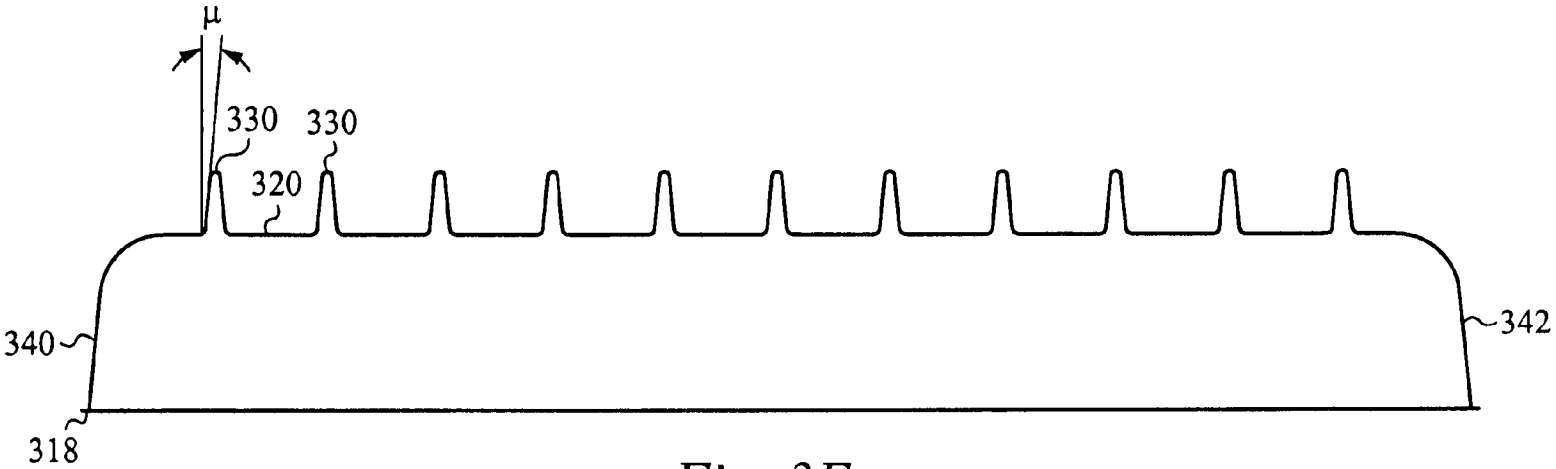
Figure 3F:
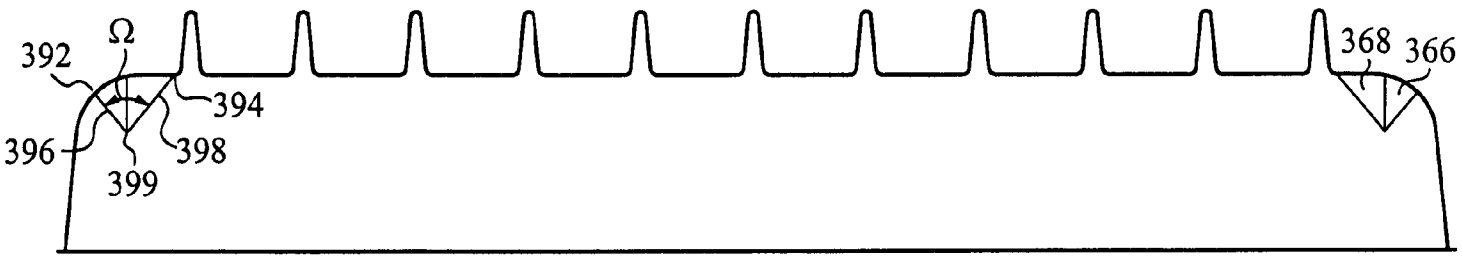
Figure 4:
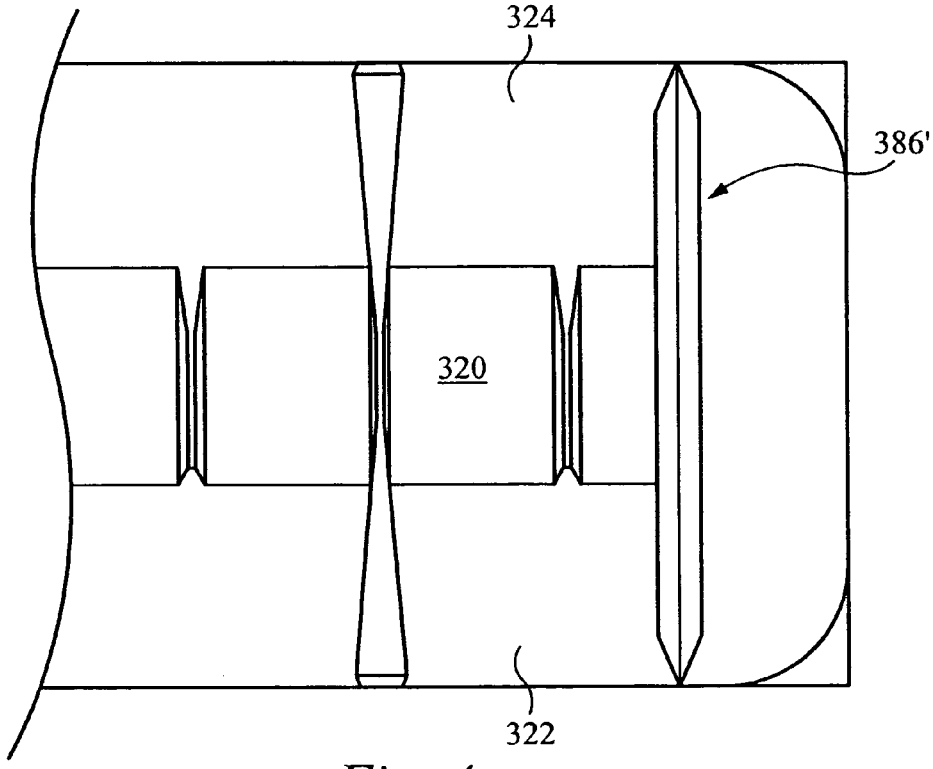
Figure 5C:
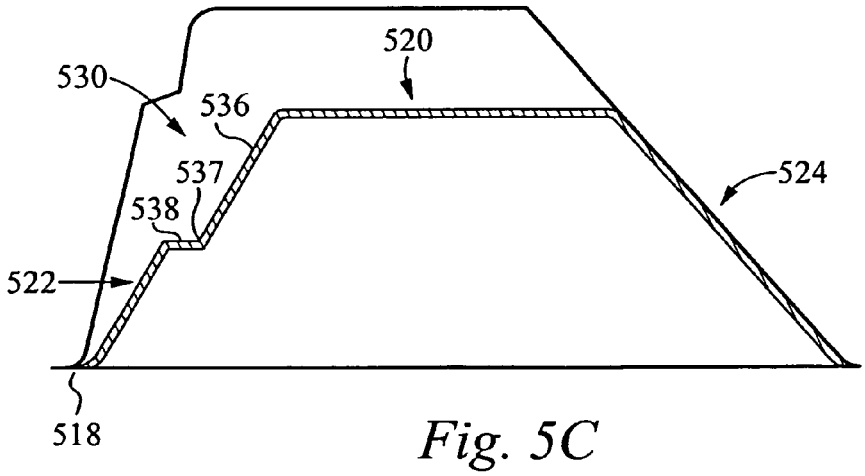
Figure 5A:
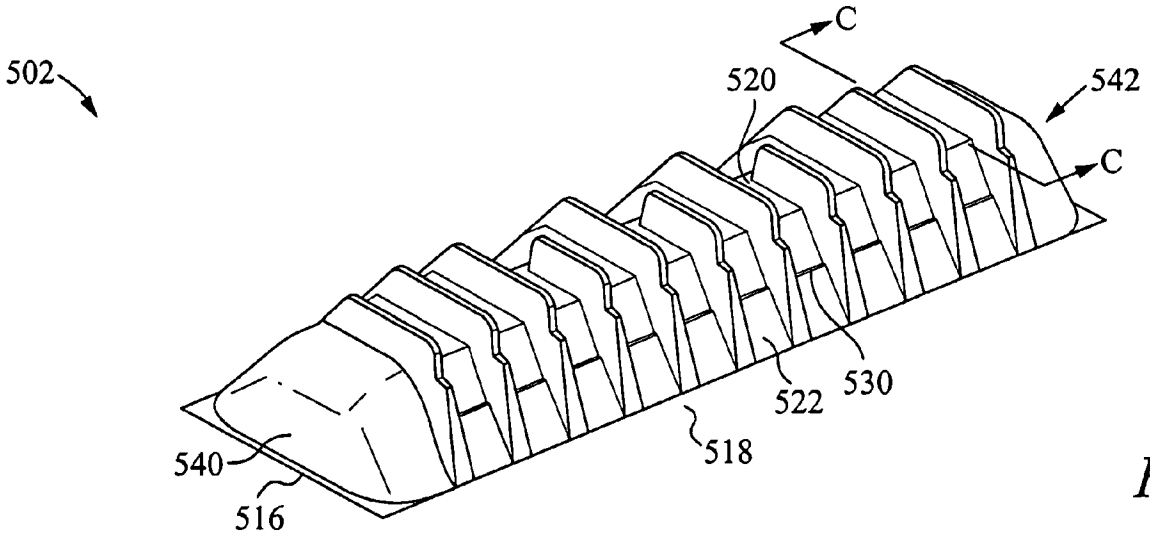
Figure 5B:
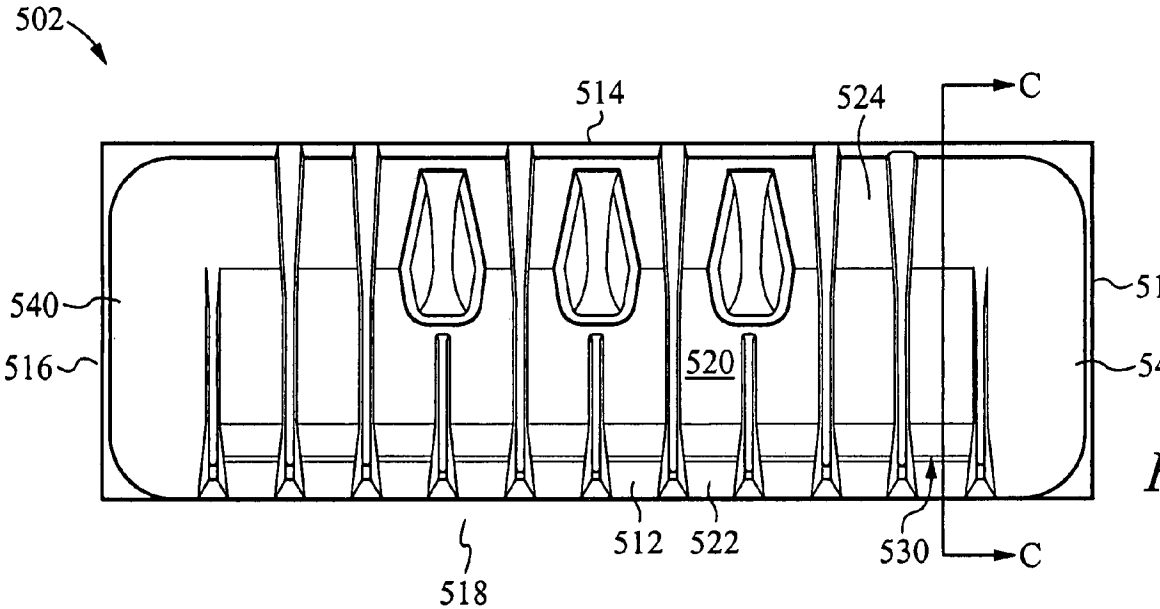

FIG. 2A a top view of six panel packaging article, according to an embodiment of the present invention;

FIG. 2B is a perspective view of the packing article of FIG. 2A, appropriately folded to fit within a shipping container;

FIG. 2C is a perspective view of the packaging article of FIGS. 2A and 2B placed into a shipping container (one of the walls is removed from the shipping container so that the packaging article can be seen);

FIG. 3A is a perspective view of an exemplary bottom panel of a packaging article, where the panel includes a plurality of unique hinges in accordance with embodiments of the present invention;

FIG. 3B is a top view of the panel shown in FIG. 3A;

FIG. 3C is a cut-away view of the panel shown in FIGS. 3A and 3B, cut along line C—C;

FIG. 3D is a cut-away view of the panel shown in FIGS. 3A and 3B, cut along line D—D;

FIG. 3E is a cut-away view of the panel shown in FIGS. 3A and 3B, cut along line E—E;

FIG. 3F is a cut-away view of the panel shown in FIGS. 3A and 3B, cut along line F—F;

FIG. 4 is a top view of a portion of a panel including an alternative embodiment of a v-hinge;

FIG. 5A is a perspective view of an exemplary side panel of a packaging article, that includes a step hinge according to an embodiment of the present invention;

FIG. 5B is a top view of the panel shown in FIG. 5A; and

FIG. 5C is a cut-away view of the panel shown in FIGS. 5A and 5B, cut along line C—C.

DETAILED DESCRIPTION OF THE INVENTION

Figure 1A:
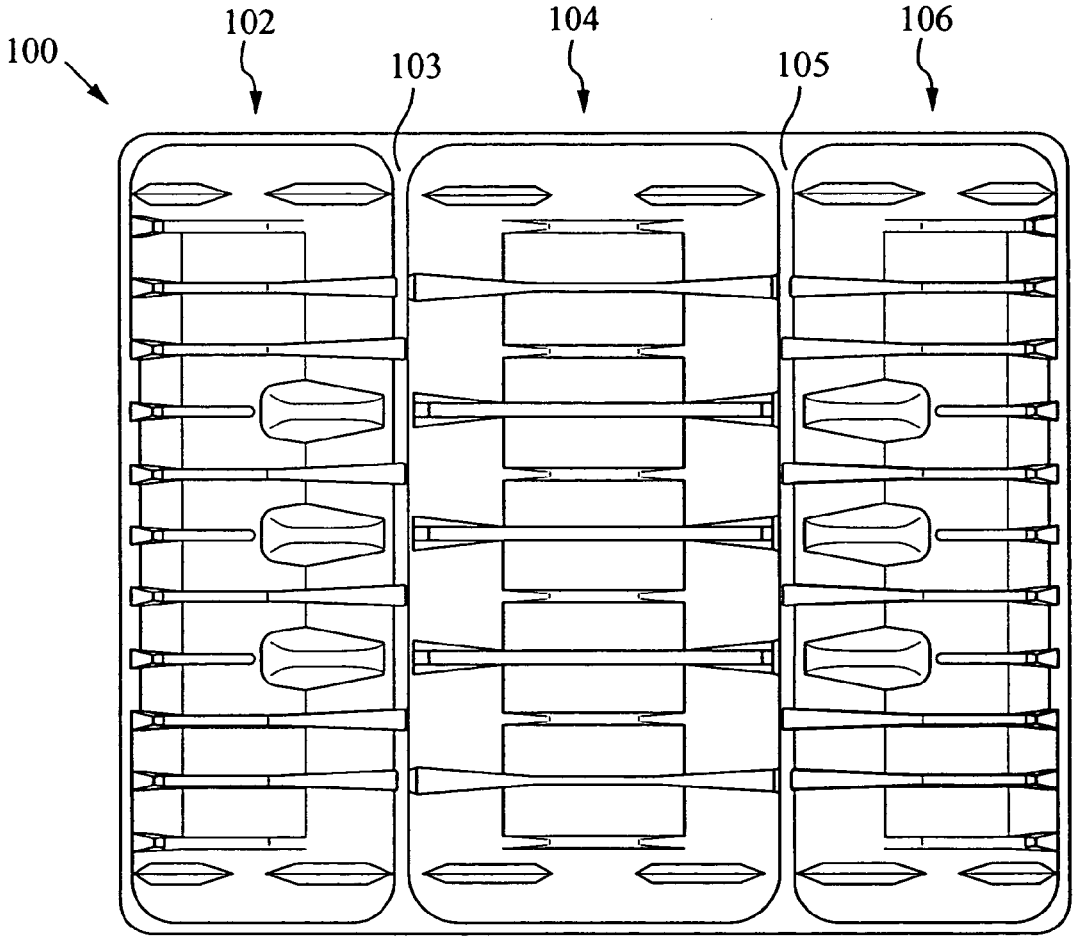
FIG. 1B is a perspective view of the packing article of FIG. 1, appropriately folded to fit within a shipping container.
FIG. 1C is a perspective view of the packaging article of FIGS. 1A and 1B placed into a shipping container (one of the walls is removed from the shipping container so that the packaging article can be seen)

FIG. 1A shows a fragility package article 100, according to an embodiment of the present invention, that includes a bottom panel 104 and a pair of side panels 102 and 106.

Article 100 is preferably formed from a single sheet of plastic by thermoforming, injection molding, blow molding, or an equivalent technology. The plastic can be a high density polyethylene (HDPE), however other polymeric materials may be substituted depending on the application, including the provision of additives for reducing static electricity. HDPE works well due to its combination of stiffness, flexibility and memory (i.e., its tendency to return to its original shape after shock loading). Sheets of plastic used to produce article 100 should typically have a thickness of about 10 to 90 gauge (mils), however other thicknesses can be used, depending on the application.

Figure 1B:
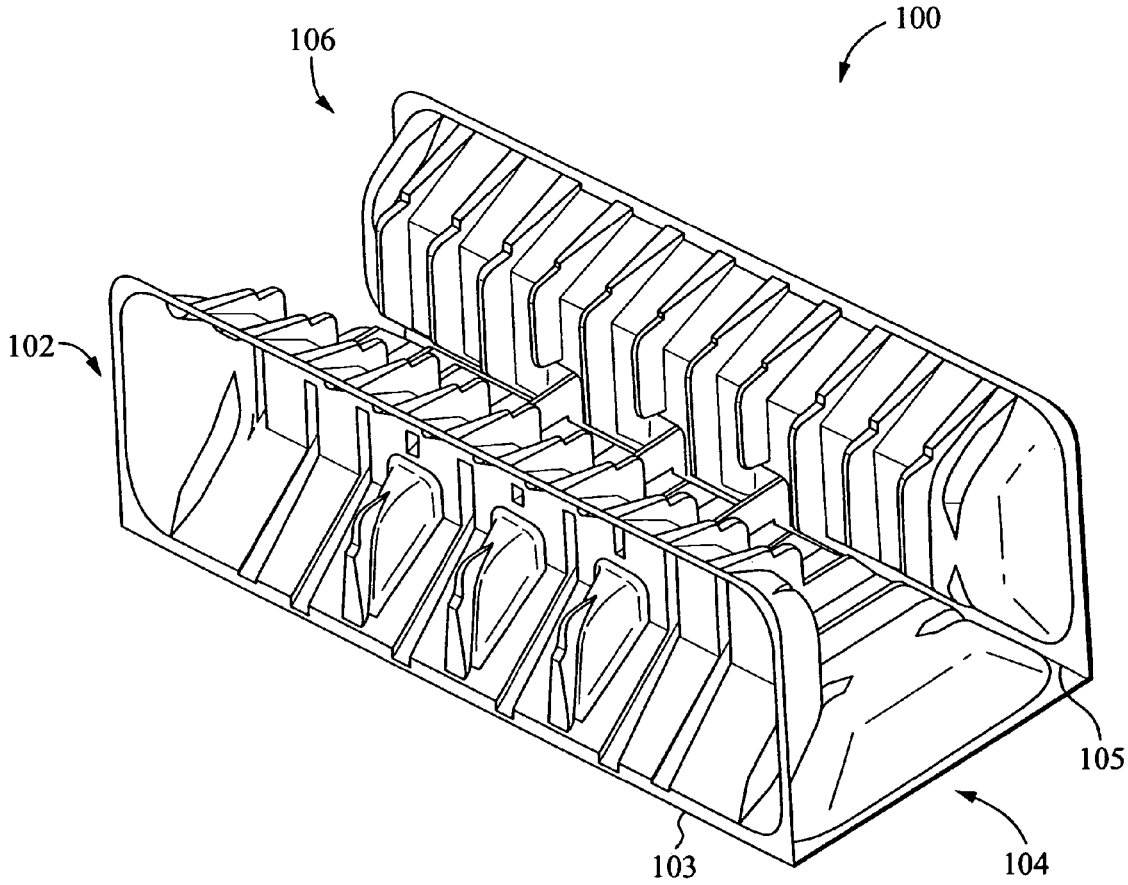
Figure 1C:
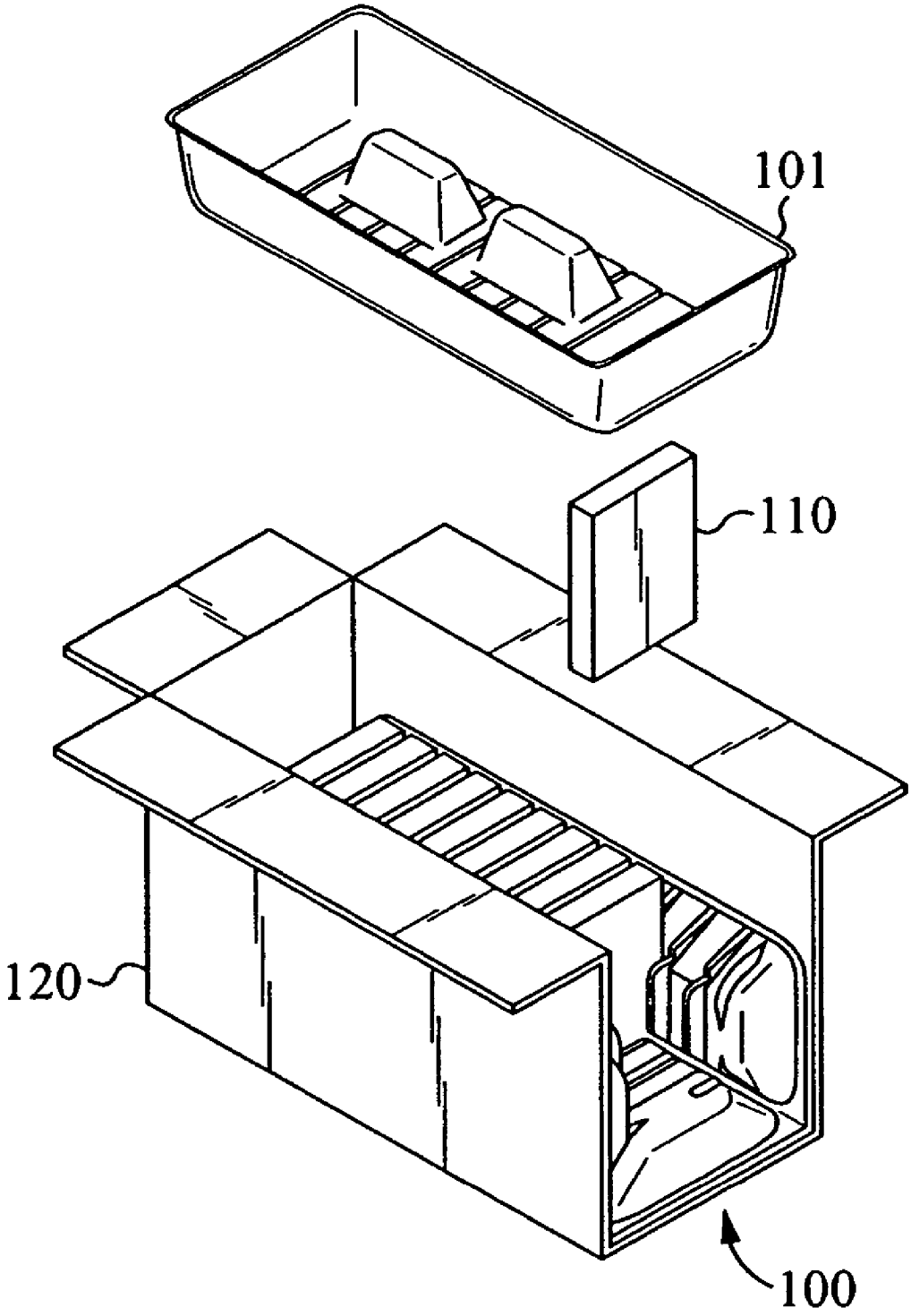

Each side panel 102 and 106 is respectively coupled to bottom panel 104 by integrally formed "living" hinges 103 and 105 that enable the panels to be hinged or bent with respect to one another. More specifically, integrally formed "living" hinge 103 allows side panel 102 to flap or bend toward bottom panel 104 so that the panels are substantially perpendicular to one another, as shown in FIG. 1B. Similarly, integrally formed "living" hinge 105 allows side panel 106 to bend or flap toward bottom panel 104, such that side panels 104 and 106 are substantially parallel to one another, as shown in FIG. 1B. In this configuration, article 100 can be placed in a shipping container 120 (e.g., a corrugated cardboard box or tote) such that a base of bottom panel 104 rests on a bottom of container 120, and side panels 102 and 106 each rest against side walls of container 120, as shown in FIG. 1C. One or more fragile items 110 can then be placed in cells formed by article 100, as will be described below.

A lid 101 can be placed over the fragile items 110 to form a cushioning distance between the top(s) of fragile item(s) 110 and the top or cover of shipping container 120 (e.g., carton flaps that are folded over to close the container). Lid 101 is a generally planar panel and is provided with cells in registry with the other cells formed by fragility packaging article 100. When lid 101 is placed over the packaged fragile items already in the container, the tops of the fragile items will also be separated from adjacent items, and lid 101 will also separate the fragile items from the corresponding top panel or panels of the container (e.g., a carton). Lid 101 can be formed (e.g., thermoformed) separately from article 100, as shown in 1C. Alternatively, lid 101 can be integrally formed with article 100 such that an integrally formed "living" hinge (similar to hinges 103 and 105) exists between one of side panels 102 or 106 and lid 101, enabling lid 101 to bend (along the hinge) such that it is perpendicular to side panels 102 and 106 and parallel to bottom panel 104. In an embodiment where the lid is integrally formed with panels 102, 104 and 106, the lid or top panel can be substantially identical to bottom panel 104.

As can be appreciated from FIGS. 1B and 1C, article 100 resembles a letter "U" when folded in the above described manner, and thus, may be referred to as a U-PADTM. However, embodiments of the present invention are not limited to this configuration. For example, the U-PADTM can be rotated 90 degrees to resemble a letter "C", and thus article 100 may be referred to as a C-PAD. In the C-PAD arrangement, bottom panel 104 acts as a side panel (and rests against a side of a shipping container), and side panels 102 and 104 act as top and bottom panels (and rest against top and bottom surfaces of the shipping contain). In this arrangement, what was referred to above as a top panel (e.g., lid 101) is now a side panel which is placed over the sides of the fragile items 110 after they are loaded into the C-PAD.

FIG. 2A shows a fragility package article 200, according to an alternative embodiment of the present invention, that includes a pair of bottom panels 204 and 210 (each substantially the same as bottom panel 104), a pair of side panels 202 and 212 (substantially the same as side panels 202 and 206), and a pair of middle panels 206 and 208. Each panel is coupled to its adjacent panel or panels by integrally formed "living" hinges (203, 205, 207, 209, 211) that enable the panels to be hinged or bent with respect to one another. For example, integrally formed "living" hinge 203 allows side panel 202 to flap toward bottom panel 204 so that the panels are substantially perpendicular to one another, as shown in FIG. 2B. Hinge 207 allows middle panels 206 and 208 to be bent 180 degrees with respect to one another such that the panels are back-to-back, as shown in FIG. 2B. Once bent into the configuration shown in FIG. 2B, article 200 can be placed in a shipping container 220 (e.g., a corrugated cardboard box) such that bases of bottom panels 204 and 210 rests on a bottom of container 220, and bases of side panels 202 and 212 each rest against side walls of container 220, as shown in FIG. 2C. One or more fragile items 230 can then be placed in cells formed by article 200, as will be described below. As can be appreciated from FIGS. 2B and 2C, fragility packaging article 200 provides two parallel rows of item storing cells (as apposed to the one row provided by article 100). A lid 201 can be placed over the fragile items 230 to form a cushioning distance between the top(s) of fragile item(s) 110 and the top or cover of shipping container 220 (e.g., carton flaps that are folded over to close the container). As can be appreciated from FIGS. 2B and 2C, article 200 resembles a pair of "U"s placed next to one another, when folded in the above described manner, and thus may be referred to as a DOUBLE U-PADTM. Fragility packaging articles can also be made to include three or more rows of items storing cells (e.g., a triple U-PAD, etc.).

Each of the above mentioned panels is similar in that each includes a base for resting on or against an inner surface (e.g., a bottom or a side) of a container. Each panel also includes a platform, located a distance or cushioning space from the base, for supporting at least a portion of a fragile item. A front wall rises from a front edge of the base to a front edge of the platform. Similarly, a rear wall rises from a rear edge of the base to a rear edge of the platform. Additionally, a first side wall rises from a first side edge of the base to a first side edge of the platform. A second side wall similarly rises from a second side edge of the base to a second side edge of the platform. The front wall, rear wall, first side wall and second side wall define a skirt that suspends the platform above the base so that a shock absorbing air cushioning space is defined between an inner surface of the container and the platform. For example, referring to FIGS. 3A and 3B, an exemplary bottom panel 304 of a fragility packaging article includes a base 318 having a peripheral edge including generally parallel front and rear edges 312, 314 and generally parallel side edges 316, 317. Panel 304 also includes a platform 320 for supporting at least a portion of a fragile item. A front wall 322 rises from front edge 312 of base 318 to a corresponding front edge of platform 320. A rear wall 324 rises from rear edge 314 of base 318 to a corresponding rear edge of platform 320. A first side wall 340 rises from first side edge 316 of base 318 to a first side edge of platform 320. A second side wall 342 rises from second side edge 317 of the base 318 to a second side edge of platform 320. Front wall 322, rear wall 324, first side wall 340 and second side wall 342 define a skirt that suspends platform 320 above base 318 so that a shock absorbing air cushioning space is defined between platform 320 and an inner surface (e.g., a bottom) of a container (e.g., a corrugated box).

In the embodiments shown in the figures, front wall 322 rises from front edge 312 of base 318 at substantially constant angle from base 318 to platform 320. Similarly, rear wall 324 rises from rear edge 314 of base 318 to platform at a substantially constant angle. Sidewalls 340 and 342 are each shown as extending up from base 318 and curving to meet platform 320. These angles at which front wall 322 and rear wall 324 rise to platform 322, and the radius of the curve between sidewalls 342 and 344 and platform 320, in part define the overall flexibility and cushioning of panel 304. For example, the steeper the angle the stiffer (i.e., less flexible) the panel.

A plurality of ribs typically project from the platform of each panel to divide each platform into one or more of item-supporting and item-separating cells, where each cell is configured to receive one fragile item. For example, a plurality of ribs 330 project from platform 320 of exemplary bottom panel 304 to divide platform 320 into a plurality of item-supporting cells, as shown in FIGS. 3A and 3B. A fragile item can be placed between opposing walls of each pair of adjacent ribs 330 such that a portion of the fragile item rests between the pair of ribs 330 and against platform 320.

In the exemplary panels shown in FIGS. 1A–1C, eleven ribs project from each panel to thereby define ten cells. Accordingly, packaging article 100 shown in FIGS. 1A–1C may be referred to as a "10-pack" in that it is used to retain ten fragile items. Exemplary bottom panel 304, shown in FIGS. 3A and 3B, similarly includes eleven ribs. Packaging article 200 shown in FIGS. 2A–2C may be referred to as a "20-pack" since two rows of tens cells are provided. It is noted, however, that features of present invention are not limited to use with the specific embodiments shown in the figures. For example, features of the present invention can be used with a packaging article designed to store a single fragile item (e.g., a video monitor), or any other number of items.

Referring to FIG. 3E, which is a cutaway side view of panel 304 along line E—E, each rib 330 is typically configured to have a slight draft angle μ selected to balance the design requirement of sufficient product contact for support purposes on the one hand, and ease of withdrawing the article (e.g., article 100 or 200) from a forming tool and withdrawing the fragile item from a cell on the other hand. It has also been found that the greater the draft angle, the more flexible rib 330, and the less resistant it is to shock loading. The draft angle of rib 330 is most likely within a range of about 3 to 45 degrees, with a preferred range of about 3 to 15 degrees.

Typically, each fragile item (e.g., item 110 or 230) packaged using embodiments of the present invention is generally rectangular in shape and in some cases may be provided in its own further wrapping or packaging, depending on the application. Examples of fragile items include, but are not limited to, disk storage drives, printed circuit boards, flat screen displays, already assembled lap top computers, set top boxes and computer processing units (CPUs).

As will be appreciated from the following description, embodiments of the present invention are directed to unique hinges that are incorporated into the above described panels (or other similar panels) to provide for, among other things, improved cushioning of fragile items. More specifically, the unique hinges of the present invention provide for predicted deformation paths thereby reducing and hopefully preventing random permanent crush zones or points from occurring within a panel. Such predicted deformation paths provide many advantages. For example, the unique hinges of the present invention provide a more efficient packaging article (e.g., article 100 or 200) in that a packaging articles that incorporate some or all of the unique hinges can handle (i.e., be used to ship) fragile items (e.g., items 110 or 230) having a broad weight range. The predicted deformation paths also provide for improved overall cushioning thereby increasing protection of fragile items and thereby significantly reducing damage that may occur to the fragile items. The unique hinges of the present invention also improve the cosmetic appearance of a fragility packing article because a majority of crushing occurs along the unique hinges, preventing random unsightly crush points from occurring throughout the article.

One or all of the different unique hinges of the present invention can be incorporated into an a single panel of a fragility packaging article. Further, one or more of each unique hinge (i.e., of a specific type of unique hinge) can be incorporated into a single panel. Each of the unique hinges shall now be discussed individually, mainly with reference to FIGS. 3A–3F. As mentioned above, panel 304 shown in FIGS. 3A–3F is an exemplary bottom panel of a fragility packing article that most likely also includes at least a pair of side panels (e.g., similar to side panels 102 and 106). As will be appreciated from the following description, one or more of the unique hinges of the present invention can be, and likely are, also incorporated into the side panels (and middle panels, when used).

Gusset Hinge

In accordance with an embodiment of the present invention, hinges are placed within gussets that are used to strengthen front and rear walls and of a panel. For example, referring to FIGS. 3A and 3B, the fifth, seventh and ninth ribs 330 (from the left) are shown as each including gussets 332 projecting up from front and rear walls 322 and 324 of panel 304. A gusset hinge 334 is located in each gusset 332 for providing a path of deformation for the gusset 332. Referring to FIG. 3C, which is a cut-away view along line C—C, gusset hinge 334 is a notch in gusset 332 and is somewhat "L" shaped in that it includes a ledge 338 and a face 336 extending up from ledge 338. A corner 337, defined between ledge 338 and face 336, is where the predicted deformation path begins, when a sufficient force is applied. Such a force typically originates outside of the shipping container (e.g., container 120 or 230). During deformation, ledge 338 and face 336 will bend toward one another about corner 337. Such deformation assists in absorbing the force, thereby preventing the force from damaging the fragile items that are stored between ribs 330. When the force is no longer applied, ledge 338 and face 336 will substantially return to their original positions.

Gusset hinges 334 provides a movement path at a chosen bearing point that is variable and can be altered indefinitely to provide more or less resistance. An exemplary bearing point is even with the level of platform 320 (i.e., at the same height from base 318 as platform 320, as can best be seen in FIG. 3C). Below or above that level will change resistance and either add or subtract stiffness. The size of gusset hinges 334 and the draft angles of its surface (i.e., ledges 338 and faces 336) can be altered to create more or less stiffness.

Gusset hinges 334 are useful for absorbing forces that are applied from any direction except from a direction substantially perpendicular to side wall 342 or side wall 344. Other hinges of the present invention, discussed below, are useful for absorbing forces applied from the direction substantially perpendicular to side wall 342 or side wall 344.

Diamond Hinge

Another unique hinge of the present invention shall be referred to as a diamond hinge because of its generally diamond shape. Referring to FIGS. 3A and 3B, a diamond hinge 360 is located in a corner area where platform 320, front wall 322, and side wall 342 all meet. A further diamond hinge 360 is located in a corner area where platform 320, rear wall 324 and side wall 342 all meet. Each diamond hinge 360 is defined by four substantially planer and substantially triangular surfaces 362, 364, 366 and 368 that meet at a point 370 located below platform 320 (i.e., when base 318 of panel 304 rests against a surface of a shipping container, point 370 is closer to that surface than platform 320).

Referring to the top view of panel 304 in FIG. 3B, diamond hinge 360 resembles a diamond through which a pair of cross-hairs 372 and 374 are drawn, with cross-hairs 372 and 374 crossing one another at point 370. These cross-hairs 372 and 374 divide the diamond shape into the four triangular surfaces 362, 364, 366 and 368. The bases of triangular surfaces 362, 364, 366 and 368 (i.e., the sides of the triangular surfaces opposite point 370) form the generally diamond shape of diamond hinge 360. These bases, as shown in the figures, may be curved (i.e., not straight) due to the shapes of the walls through which the triangular surfaces intersect. For example, a base of triangular surface 364 is curved because it intersects with side wall 342, which as described above curves to meet platform 320. Similarly, a base of triangular surface 366 is curved because it also intersects side wall 342.

The lengths of the above described cross-hairs can be varied, thereby altering the overall shape and size of diamond hinge 360 (as well as the shapes and sizes of triangular surfaces 362, 364, 366 and 368). The precise shape and size of diamond hinge 360 is dependent on the application. For example, a larger diamond hinge will provide a longer and generally more flexible (i.e., less stiff) deformation path than a smaller diamond hinge. Also, as is the case for all the unique hinges of the present invention, the thickness of the plastic making up the hinge will affect the stiffness of the hinge. Generally, the thinner the plastic making up the hinge, the more flexible (and weaker) the hinge. The converse is also generally true. The thicker the plastic making up the hinge, the stiffer (and stronger) the hinge. The plastic thickness selected for a particular application should have the right balance of flexibility and stiffness taking into account, among other things, the size and weight of the fragile items being packaged.

In the embodiment shown in FIGS. 3A and 3B, cross-hairs 372 and 374 are substantially perpendicular to one another. Accordingly, in this exemplary embodiment, each of the triangular surfaces 362, 364, 366 and 368 includes a substantially right (i.e., 90 degree) angle.

Each diamond hinge 360 provides at least two predicted deformation paths. Cross-hair 372 defines where one of the predicted deformation paths begin. During deformation, triangular surfaces 366 and 364 will bend toward triangular surfaces 368 and 362 along cross-hair 372 when, for example, a sufficient force is applied in a direction perpendicular to one of side walls 342 and 340 (e.g., a force applied in the direction of arrow 380). Such deformation assists in absorbing the force, thereby preventing the force from damaging the fragile items that are stored between ribs 330. When the force is no longer applied, the triangular surfaces will substantially return to their original positions.

Cross-hair 374 defines where a second predicted deformation path begins. During deformation, triangular surfaces 362 and 364 will bend toward triangular surfaces 368 and 366 along cross-hair 377 when, for example, a sufficient force is applied in a direction toward front wall 342 or rear wall 340 (e.g., a force applied in the direction of arrow 382). Such deformation assists in absorbing the force, thereby preventing the force from damaging the fragile items that are stored between ribs 330. When the force is no longer applied, the triangular surfaces will substantially return to their original positions.

Diamond hinge 360 may hinge in accordance with mainly one of the above described deformations paths, or simultaneously in accordance with both of the above described deformation paths, depending upon where a force is applied. For example, if a force is applied in a direction of arrow 384 shown in FIG. 3A (e.g., toward an upper corner of a container within which bottom panel 304 is sitting), it is likely that diamond hinge 360 will hinge along both of the above described paths. Because of its shape and its location, diamond hinge 360 may tweak or twist while absorbing such a force. However, once the force is no longer applied diamond hinge 360 will substantially return to its original shape.

V-Hinge

A further unique hinge of the present invention shall be referred to as a v-hinge because of its generally "V" like shape. Referring to FIGS. 3A and 3B, a V-hinge 386 extends into front wall 322 close to where front wall 322 meets with side wall 340. v-hinge 386 includes a first v-shaped end 388 in front wall 324 with a tip pointing generally toward front edge 312 of base 318. A second v-shaped end 390 is located in platform 320 with a tip pointing generally away from front edge 312 of base 318. Generally parallel edges 392 and 394 extend between first v-shaped end 388 and second v-shaped end 390. First and second walls 396 and 398 extend down, respectively, from edges 392 and 394 and meet at a trough 399, thereby forming a v-shaped channel. Similarly, a further v-hinge 386 extends into rear wall 324 and platform 320 close to where rear wall 324 meets with side wall 340.

As can be seen in FIG. 3D, which is a cut-away view along line D—D shown in FIGS. 3A and 3B, edge 394, wall 396 and trough 399 (as well as edge 392 and wall 396) of v-hinge 386 curve or bend in a similar manner as does front wall 322 (and rear wall 324) as it meets platform 320. This is because the v-shaped channel of v-hinge 386 extends into both front wall 322 and platform 320. As can also be seen in FIG. 3D, a width of wall 398 is substantially constant along its length, except near first v-shaped end 388 and second v-shaped end 390, where the width of wall 398 tapers to a point. The same is true for wall 396, which has substantially the same shape as wall 398.

V-hinges 386 are useful for absorbing forces that are applied from a direction substantially perpendicular or parallel to side wall 342 or side wall 344 (e.g., a force along arrow 380). Trough 399 is where the predicted deformation path begins, when a sufficient force is applied. During deformation, first and second walls 396 and 398 will bend toward one another about trough 399. As walls 396 and 398 bend toward one another, an angle θ between each v-shape end 390 and 388 gets smaller. Also, as walls 396 and 398 bend toward one another, an angle Ω defined between walls 396 and 398 gets smaller (best seen in FIG. 3F, which is a cross-section view along line F—F shown in FIGS. 3A and 3B). Such deformation assists in absorbing the force, thereby preventing the force from damaging the fragile items that are stored between ribs 330. When the force is no longer applied, first and second walls 396 and 398 will substantially return to their original positions, and angle θ and angle Ω will each substantially return to their original angles.

In exemplary panel 304, one v-hinge 386 extends into front wall 322 and platform 320 close to where front wall 322 and platform 320 meet with side wall 340, and the other v-hinge 386 extends into rear wall 324 and platform 320 close to where rear wall 322 and platform 320 meet with side wall 340. It is beneficial to have the v-hinges 286 located close a side wall (e.g., side wall 340 or 342) so that the predicted deformation path in front wall 322, rear wall 324 and platform 320 occurs outside the area where fragile items are stored (i.e., outside of the region made up of cells 352 between ribs 330). The same is true for diamond hinges 360 discussed above. However, v-hinges 386 can alternatively (or additionally) be placed at other locations along front wall 322 and/or rear wall 324. That is, the v-hinge need not be located near a side wall (i.e., near side wall 340 or 342). For example, a v-hinge 386 can extend into front wall 322 at a location between the forth and fifth ribs 330 (from the left) and another v-hinge 386 can extend into rear wall 324 between the same forth and fifth ribs 330. V-hinges may even extend into sidewalls 340 and/or 342.

Preferably, v-hinges 386 are used as pairs of hinges so that substantially equal deformation occurs in each of the front wall 322 and rear wall 324. In another embodiment, rather than using a pair of v-hinges 386, a single elongated v-hinges 386' extends into front wall 322, into and across the entire width of platform 320, and into rear wall 324, as shown in FIG. 4. Such an elongated v-hinge 386' is more flexible than a pair of v-hinges 386, because there is no flat portion of platform 320 between v-shaped ends 390 of the pair of v-hinges 386 to resist flexing.

Observing FIGS. 3A and 3B, exemplary bottom panel 304 is shown as including a total of six gusset hinges 332, two diamond hinges 360 and two v-hinges 386. However, these precise numbers of each hinge are only for example. In another example, a panel includes four diamond hinges 360 (e.g., the two shown, and one replacing each v-hinge 386). In another example, a panel includes four v-hinges 386 (e.g., the two shown, and one replacing each diamond hinge 360). In another example, a panel includes only gusset hinges 332, but no diamond hinges 360 or v-hinges 386. More generally, one or all of the above described unique hinges of the present invention can be incorporated into an a single panel of a fragility packaging article. Further, one or more of each unique hinge (i.e., of a specific type of unique hinge, such as diamond hinge 360) can be incorporated into a single panel. The selection of which hinges to use, and how many of each hinge to use is dependent upon the many factors such as, but not limited, the weight (or range of weights) of the fragile items being protected, the fragility of the fragile items being protected, the number of fragile items being protected, the dimensions of the panel, and potential drop height.

Referring back to FIGS. 1A and 1B, it can be seen that each panel 102, 104 and 106 of fragility packaging article 100 includes four v-hinges. It can also be seen that bottom panel 104 includes six-gusset hinges, similar to bottom panel 304. Each side panel 102 and 106 includes eleven gusset hinges 332, all located on a same wall (e.g., the front wall) of each side panel. Referring back to FIGS. 2A and 2B, it can be seen that v-hinges are also included in middle panels 206 and 208. Gusset hinges 332 and/or diamond hinges can also be included in middle panels 206 and 208, if desired.

Step Hinge

A further unique hinge of the present invention, referred to as a step hinge because of its step like shape, shall now be described with reference to FIGS. 5A–5C. Referring to FIGS. 5A and 5B, an exemplary side panel 502 of a fragility packaging article includes a base 518 having a peripheral edge including generally parallel front and rear edges 512, 514 and generally parallel side edges 516, 517. Panel 502 also includes a platform 520 for supporting at least a portion of a fragile item. A front wall 522 rises from front edge 512 of base 518 to a corresponding front edge of platform 520. A rear wall 524 rises from rear edge 514 of base 518 to a corresponding rear edge of platform 520. A first side wall 540 rises from first side edge 516 of base 518 to a first side edge of platform 520. A second side wall 542 rises from second side edge 517 of the base 518 to a second side edge of platform 520. Front wall 522, rear wall 524, first side wall 540 and second side wall 542 define a skirt that suspends platform 520 above base 518 so that a shock absorbing air cushioning space is defined between platform 520 and an inner surface (e.g., a side) of a container (e.g., a corrugated box).

In this exemplary embodiment, a step hinge 530 extends substantially the entire length of front wall 522 to provide a predicted deformation path for front wall 522. Referring to FIG. 5C, which is a cut-away view along line C—C shown in FIGS. 5A and 5B, step hinge 530 is somewhat "L" shaped in that it includes a ledge 538 and a face 536 extending up from ledge 538. A corner 537, defined between ledge 538 and face 536, is where the predicted deformation path begins, when a sufficient force is applied. During deformation, ledge 538 and face 536 will bend toward one another about corner 537. This deformation assists in absorbing the force. When the force is no longer applied, ledge 538 and face 536 will substantially return to their original positions. As is apparent from this description, step hinge 530 is similar to the gusset hinge described above, except that a step hinge is located within in front wall 522 (or rear wall 524, side wall 516 and/or side wall 517), rather than being located within a gusset extending up from the wall. Rather than extending substantially the entire length of front wall 522, step hinge 530 may alternatively extent a shorter portion of the entire length.

A step hinge 530 can be used in a panel that incorporates gussets, as shown in FIGS. 5A–5C, or may be used in a panel that does not incorporate gussets. When used in the same wall that includes one or more gussets, the gussets split or separate step hinge 530 into multiple sections. For example, as shown in FIGS. 5A and 5B, eleven gussets project from front wall 522, thereby separating step hinge 530 into ten sections, with each section being defined between a pair of adjacent gussets. As shown in FIGS. 5A–5C, each of the gussets may include a gusset hinge. More generally, the step hinge of the present invention can be used with any of the other unique hinges described above. In this example, step hinge 530 is shown as being included in an exemplary side panel 502 of a fragility packaging article. Step hinges can similarly be incorporated into other panels, e.g., bottom panels or middle panels of a fragility packaging article.

It is noted that terms such as "first" and "second" have often been used herein to differentiate elements. However, a first element and a second element may be substantially similar. Further, the selection of which element is named the "first" as opposed to the "second" is typically arbitrary. This is also true for the use of the terms "front" and "rear."

In its many embodiments, the fragility packaging articles of the present invention provide many features which may be employed in a variety of combinations to provided customized fragility packaging to accommodate almost any conceivable design requirement, or manufacturer's specification. Depending on the application, the relative rigidity of the diamond hinges, the v-hinges, the gusset hinges and the step hinges can be adjusted. This can be accomplished by adjusting the size of the hinges, the thickness of the plastic making up the hinges, the relative angles between surfaces of the hinges, and the like.

While particular embodiments of improved fragility packaging articles have been shown and described, it will be appreciated by those skilled in the art that changes and modifications may be made thereto without departing from the invention in its broader aspects and as set forth in the following claims.

What is claimed is:

1. A fragility packaging article panel for use in retaining and protecting at least one fragile item within a container, the panel comprising:

a base for resting on or against a panel of the container;

a platform for supporting at least a portion of the at least one item;

a skirt that suspends said platform above said base so that a shock absorbing air cushioning space is defined between the inner surface of the container and said platform; and a diamond hinge located in a corner area where said platform and said skirt meet, said diamond hinge being defined by four substantially triangular surfaces that meet at a point located below said platform, said diamond hinge providing at least two predicted paths for deformation.

2. The panel according to claim 1, further comprising a plurality of ribs projecting from said platform to define at least one item-supporting cell, each said cell configured to receive a fragile item.

3. The panel according to claim 1, wherein an outer edge of said diamond hinge has a generally diamond shape, said diamond shape being divided into said four triangular surfaces by a pair of cross-hairs.

4. The panel according to claim 3, wherein:

a first of said cross-hairs defines a line along which a first pair of said triangular surfaces bend toward a second pair of said triangular surfaces during a first predicted deformation path; and a second of said cross-hairs defines a line along which a third pair of said triangular surfaces bend toward a fourth pair of said triangular surfaces during a second predicted deformation path.

5. The panel according to claim 4, wherein a base of one or more of said triangular surfaces is curved, each said base being an edge of one of said triangular surfaces opposite said point where said triangular surfaces meet, said bases of said four triangular surfaces collectively defining said outer edge of said diamond hinge.

6. The panel according to claim 1, wherein said panel includes at least a pair of said diamond hinges.

7. A fragility packaging article panel for use in retaining and protecting at least one fragile item within a container, the panel comprising:

a base having a peripheral edge including generally parallel front and rear edges and generally parallel first and second side edges, said base for resting on or against a panel of the container;

a platform for supporting at least a portion of the at least one fragile item, said platform including generally parallel front and rear edges and generally parallel first and second side edges;

a skirt that suspends said platform above said base so that a shock absorbing air cushioning space is defined between the inner surface of the container and said platform; and a v-hinge extending into said skirt and into said platform, said v-hinge including:

a first v-shaped end in said skirt with a tip pointing generally toward said base;

a second v-shaped end in said platform with a tip pointing generally away from said first v-shaped end;

generally parallel edges that extend between said first v-shaped end and said second v-shaped end; and first and second walls extending down from said edges and meeting at a trough to thereby form a v-shaped channel, wherein said v-shaped channel is generally parallel to said first and second side edges of said platform.

8. The panel according to claim 7, further comprising a plurality of ribs projecting from said platform to define at least one item-supporting cell, each said cell configured to receive a fragile item.

9. The panel according to claim 7, wherein said v-hinge provides a predicted path for deformation, wherein during deformation said first and second walls of said v-hinge bend toward one another along said trough.

10. The panel according to claim 9, further comprising a second said v-hinge extending into said skirt and into said platform.

11. The panel according to claim 10, wherein said v-shaped channels of both said v-hinges are generally in line with one another.

12. The panel according to claim 10, wherein said v-shaped channels of both said v-hinges are generally parallel to one another.

13. A fragility packaging article panel for use in retaining and protecting at least one fragile item within a container, the panel comprising:

a base having a peripheral edge including generally parallel front and rear edges and generally parallel first and second side edges, said base for resting on or against a panel of the container;

a platform for supporting at least a portion of the at least one fragile item, said platform including generally parallel front and rear edges and generally parallel first and second side edges;

a skirt that suspends said platform above said base so that a shock absorbing air cushioning space is defined between the inner surface of the container and said platform; and a v-hinge extending into a side of said skirt, into and across an entire width of said platform, and into an opposite side of said skirt, said v-hinge including:

a first v-shaped end including a tip pointing generally toward said front edge of said base;

a second v-shaped end including a tip pointing generally toward said rear edge of said base;

generally parallel edges that extend between said first v-shaped end and said second v-shaped end; and first and second walls extending down from said edges and meeting at a trough to thereby form a v-shaped channel;

wherein said v-shaped channel is generally parallel to said first and second side edges of said base;

wherein said v-hinge provides a predicted path for deformation, wherein during deformation said first and second walls of said v-hinge bend toward one another along said trough.

14. A fragility packaging article panel for use in retaining and protecting at least one fragile item within a container, the panel comprising:

a base for resting on or against a panel of the container;

a platform for supporting at least a portion of the at least one fragile item;

a skirt that suspends said platform above said base so that a shock absorbing air cushioning space is defined between the inner surface of the container and said platform;

a plurality of ribs projecting from said platform to define at least one item-supporting cell, each said cell configured to receive a fragile item, at least one of said ribs including a gusset portion projecting from said skirt to provide additional strength to said at least one of said ribs and to said skirt; and a gusset hinge located in said gusset portion for providing a path of deformation for said gusset.

15. The panel according to claim 14, wherein said gusset hinge comprises a notch in an outer peripheral wall of said gusset portion.

16. The panel according to claim 15, wherein said notch includes a ledge and a face meeting at a corner, and wherein said ledge and said face bend toward one another along said corner during deformation.

17. The packing article as define in claim 16, wherein said ledge is substantially parallel to said platform.

18. A fragility packaging article panel for use in retaining and protecting at least one fragile item within a container, the panel comprising:

a base for resting on or against an inner surface of the container;

a platform for supporting at least a portion of the at least one fragile item;

a skirt that suspends said platform above said base so that a shock absorbing air cushioning space is defined between the inner surface of the container and said platform; and a step hinge within at least a portion of said skirt, said step hinge including a ledge and a face meeting at a corner, and wherein said ledge and said face bend toward one another along said corner during deformation.

19. The packing article as define in claim 18, wherein said ledge is substantially parallel to said platform.

20. The panel according to claim 18, further comprising a plurality of ribs projecting from said platform to define at least one item-supporting cell, each said cell configured to receive one fragile item.

21. The panel according to claim 20, wherein at least one of said ribs including a gusset portion projecting from said skirt to provide additional strength to said at least one of said ribs and to said skirt.

22. The panel according to claim 21, wherein each said gusset portion splits said step hinge into separate sections.

* * * * *

UNITED STATES PATENT AND TRADEMARK OFFICE

CERTIFICATE OF CORRECTION

PATENT NO. : 7,134,553 B2
APPLICATION NO. : 10/900708
DATED : November 14, 2006
INVENTOR(S) : Thomas Stephens It is certified that error appears in the above-identified patent and that said Letters Patent is hereby corrected as shown below:

Column 15, claim 17, line 30: the word “define” should read -- defined --.

Column 16, claim 19, line 17: the word “define” should read -- defined --.

Column 16, claim 21, line 24 second line: the word “including” should read -- include --.

Signed and Sealed this

Twenty-eighth Day of August, 2007

JON W. DUDAS
*Director of the United States Patent and Trademark Office*